US008403380B2

(12) United States Patent
Ballhause

(10) Patent No.: US 8,403,380 B2
(45) Date of Patent: Mar. 26, 2013

(54) COVER CLOSURE FOR HOUSING COVER OF LABORATORY DEVICES AND THE LIKE

(75) Inventor: Thomas Ballhause, Herzberg (DE)

(73) Assignee: Thermo Electron LED GmbH, Langenselbold (DE)

( * ) Notice: Subject to any disclaimer, the term of this patent is extended or adjusted under 35 U.S.C. 154(b) by 344 days.

(21) Appl. No.: 12/388,958

(22) Filed: Feb. 19, 2009

(65) Prior Publication Data

US 2009/0212580 A1 Aug. 27, 2009

(30) Foreign Application Priority Data

Feb. 21, 2008 (DE) ..... 10 2008 010 272

(51) Int. Cl.
*E05C 3/06* (2006.01)
*E05B 15/02* (2006.01)

(52) U.S. Cl. ..... 292/201; 292/216; 292/341.16; 292/DIG. 23

(58) Field of Classification Search ..... 292/201, 292/216, 341.16, DIG. 11, DIG. 23; 49/280
See application file for complete search history.

(56) References Cited

U.S. PATENT DOCUMENTS

| | | | | |
|---|---|---|---|---|
| 4,093,176 | A * | 6/1978 | Contastin | 249/167 |
| 4,159,136 | A * | 6/1979 | Kimball | 292/111 |
| 4,374,320 | A * | 2/1983 | Barnett | 219/413 |
| 4,406,486 | A * | 9/1983 | White | 292/144 |
| 4,427,929 | A * | 1/1984 | Andrei-Alexandru et al. | 318/282 |
| 4,434,635 | A * | 3/1984 | Borgato | 70/279.1 |
| 4,796,932 | A * | 1/1989 | Tame | 292/112 |
| 4,851,742 | A * | 7/1989 | Chapman | 318/286 |
| 4,870,409 | A * | 9/1989 | Ogino | 340/5.72 |
| 4,892,339 | A * | 1/1990 | Kleefeldt et al. | 292/201 |
| 5,280,975 | A * | 1/1994 | Tscheu et al. | 292/251 |
| 5,290,076 | A * | 3/1994 | Smith | 292/25 |
| 5,391,360 | A | 2/1995 | Kochte et al. | |
| 5,423,582 | A * | 6/1995 | Kleefeldt | 292/201 |
| 5,639,130 | A * | 6/1997 | Rogers et al. | 292/216 |
| 6,076,868 | A * | 6/2000 | Roger et al. | 292/201 |
| 6,315,336 | B1 * | 11/2001 | Swartzell | 292/201 |
| 6,540,270 | B1 * | 4/2003 | Reddmann | 292/201 |
| 2001/0024039 | A1 * | 9/2001 | Lippoldt et al. | 292/197 |
| 2001/0048227 | A1 * | 12/2001 | Kachouh | 292/216 |
| 2005/0167990 | A1 * | 8/2005 | Orzech et al. | 292/201 |

FOREIGN PATENT DOCUMENTS

| | | |
|---|---|---|
| DE | 40 25 134 C1 | 11/1991 |
| DE | 100 17 314 A1 | 10/2001 |
| EP | 0 819 471 A1 | 1/1998 |
| EP | 1 136 745 A2 | 9/2001 |

OTHER PUBLICATIONS

United Kingdom Intellectual Property Office, Combined Search and Examination Report Under Sections 17 & 18(3), Application No. GB0902501.6, date of report May 1, 2009 (3 pages).

* cited by examiner

*Primary Examiner* — Thomas Beach
*Assistant Examiner* — Nathan Cumar
(74) *Attorney, Agent, or Firm* — Wood, Herron & Evans, LLP

(57) ABSTRACT

A cover closure for housings of laboratory devices and the like, in particular for centrifuge housings, in which a cover hook is engaged by a closure hook and brought into a closing position, and the closing and opening movement of the closure hook essentially being caused by an eccentric in connection with a crank guide and a guide path.

9 Claims, 3 Drawing Sheets

COVER CLOSURE FOR HOUSING COVER OF LABORATORY DEVICES AND THE LIKE

The present application claims the priority under 35 U.S.C. §119 of German Patent Application No. 102008010272.5, filed Feb. 21, 2008, the disclosure of which is hereby incorporated herein by reference in its entirety.

FIELD OF THE INVENTION

The invention relates generally to a cover closure for a laboratory device and, in particular, for a centrifuge housing.

BACKGROUND OF THE INVENTION

Laboratory devices, in particular for chemical, medical, and biological applications, typically have a housing which encapsulates the devices. The housing is predominantly used so that the hazard potential which is intrinsic to such devices is kept low for the operator and the surrounding structures. The housing may be implemented as explosion-proof, for example. With centrifuges which rotate at moderate and high speeds, a large hazard potential arises from the rotors, whose kinetic energy is suddenly released in case of a rotor fracture. Therefore, the housings for laboratory devices and the like have been the subject of intensive development work for years.

A housing of the relevant type has a housing bottom part and at least one housing cover, which is typically implemented integrally. Such a housing is known, for example, from DE 100 17 314 A1.

The cover closure has an essential significance. On the one hand, the housing cover must be held closed by high forces, on the other hand, the opening and closing of the cover is to be able to be performed with little effort and in the shortest possible time. In addition, the components of the cover closure are to be situated in such a way that they are not significantly damaged in case of an accident. In the event of a malfunction, the affected laboratory device is to be able to still be opened after shutdown. A further requirement is that the closure mechanism is not to occupy excessive installation space and is additionally to be as wear-free, low maintenance, and thus reliable as possible.

Cover closures according to the prior art are also known, for example, from Patent Specifications EP 0 819 471 A1, DE 40 25 134 C1, and EP 1 136 745 A2.

There is a need to provide a low-maintenance cover closure for a housing cover of a laboratory device and the like which is simple to operate. There is also a need to provide such a cover closure in which high retention forces may be implemented with comparatively low installation space.

According to one embodiment of the present invention, the cover closure has a closure hook, which is mounted on an eccentric so it is pivotable and/or rotatable and is only movable translationally into the closing position by rotation of the eccentric, after it has engaged in a closure element belonging to the housing cover, which is preferably performed by rotation by a specific angle around the pivot axis.

The closing using the cover closure is performed in two phases. In the first phase, the closure hook engages in at least one corresponding closure element on the housing cover, such as a cover hook. In a second phase, the closure hook is moved translationally in the closing direction, the housing cover being pulled closed with high force until finally a final closing position is reached. The two phases may also overlap in time. The translational movement of the closure hook occurs via an eccentric on which the closure hook is simultaneously mounted so it is pivotable.

In the meaning of the present invention, an eccentric is understood as a cam or disk cam, whose area center of gravity or centerpoint is not coincident with the axis of rotation. The centerpoint is accordingly outside the axis of the driving shaft. Rotational movements may thus be converted into translational movements (and vice versa). The eccentricity is a measure of the spacing of centerpoint and axis of rotation. The mechanical lever laws apply for the generated and transmitted forces and torques.

An extremely compact construction for the cover closure according to one embodiment of the present invention advantageously results in this way, so that it may be situated without problems on a housing bottom part, preferably integrated in the housing wall. High closing forces may simultaneously be generated, which securely close the housing cover. In addition, the cover closure according to one embodiment of the present invention may be operated largely automatically, which additionally increases in the safety.

In an advantageous refinement of the cover closure according to one embodiment of the present invention, the eccentric has a circular outline, whereby an especially good pivot connection to the closure hook results. In addition, the eccentric is situated eccentrically and/or asymmetrically on an eccentric driveshaft, which rotationally drives the eccentric. Due to the offset of eccentric centerpoint and driveshaft linkage point, an eccentricity is formed which decisively causes the translational movement of the closure hook.

In addition, according to another aspect, the closure hook is guided using a pin and/or guide pin in a crank, whereby the movement path for the closure hook is predefined and may advantageously be restricted in its degrees of freedom. In addition, the safety is increased, because the crank additionally retains the closure hook if a malfunction occurs on the laboratory device. The crank is preferably situated on a central retention and guide plate.

According to another refinement, the closure hook has a guide section (and/or guide path or contour), which optionally works together with a guide pin on a central retention and guide plate to move the closure hook into an opening position, i.e., a position which releases the housing cover.

In yet another refinement, the closure hook is pre-tensioned spring-loaded, i.e., using a spring, into the engaging pivot position, in which it engages in the corresponding closure element on the housing cover.

According to a further refinement, the closure hook is equipped with a slide guide or bevel, on which the corresponding closure element of the housing cover, such as a corresponding cover hook, may slide during closing of the housing cover and preferably pivot the closure hook, whereby simple closing of the housing cover preferably results.

Furthermore, in one embodiment, a motor drive is included which drives the eccentric using an eccentric driveshaft, whereby on the one hand defined closing forces may be generated and on the other hand the closing and/or opening may be performed largely automatically. For such automation, it is also advantageous if at least one cam lug is situated on the eccentric, which actuates at least one micro-switch to allow a rotational angle control. In this way it is also possible to detect a position of the closure hook.

To also be able to loosen the cover closure manually after occurrence of a malfunction or in the event of power loss, for example, according to another refinement, at least the closure hook, as well as its eccentric together with the drive, are situated on a rocker, which is fastened around a point of rotation on the retention and guide plate. A latch may be provided to release and/or block the rocker in relation to the retention and guide plate. The rocker is advantageously retained and/or released in position loaded by a rotational spring using this latch. In addition, it is advantageous if the latch and the closure hook are connected via a coupling element. This is accordingly a so-called emergency unlocking latch having coupling part.

The invention is explained in greater detail hereafter on the basis of an exemplary embodiment in connection with the figures.

DETAILED DESCRIPTION OF THE INVENTION

Figure 1:
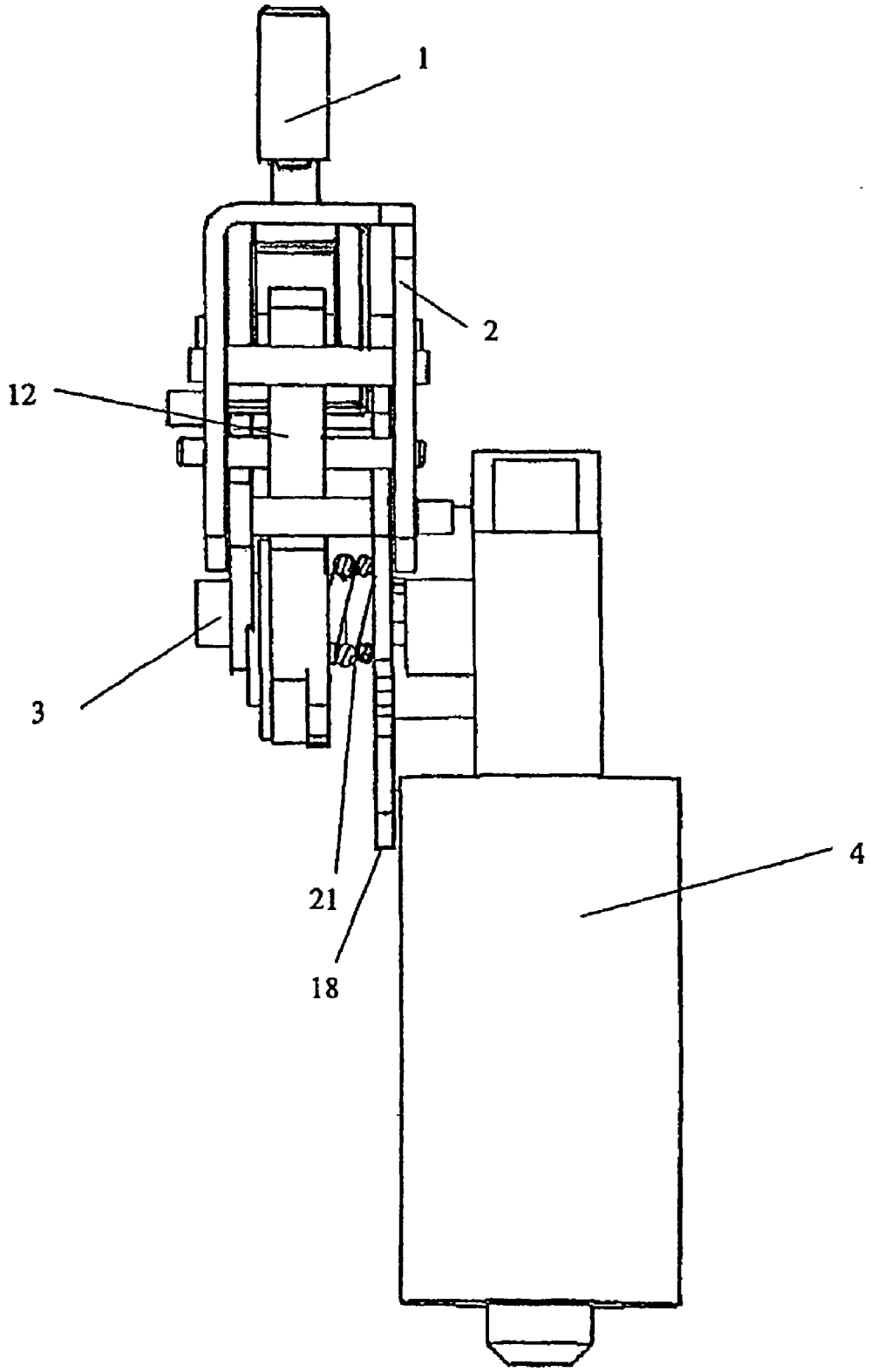
FIG. 1 shows a side view of an exemplary embodiment of the cover closure according to the invention in a schematic view.

FIG. 1 shows an exemplary embodiment of the cover closure according to the invention in a schematic side view. A cover hook 1 is shown on top in the illustration, which is situated on a housing cover (not shown). Alternatively to the cover hook 1, a groove or the like may also be situated on the housing cover. The cover closure comprises a retention and guide plate (and/or a closure housing plate) 2, on which multiple components are situated, in particular a rocker 18 and a closure hook 12. On the rear of the retention and guide plate 2 (on the right thereof in the illustration), a drive 4, such as an electric or hydraulic motor, is located, which drives an eccentric driveshaft 3 via a conversion and deflection gear.

Figure 2:
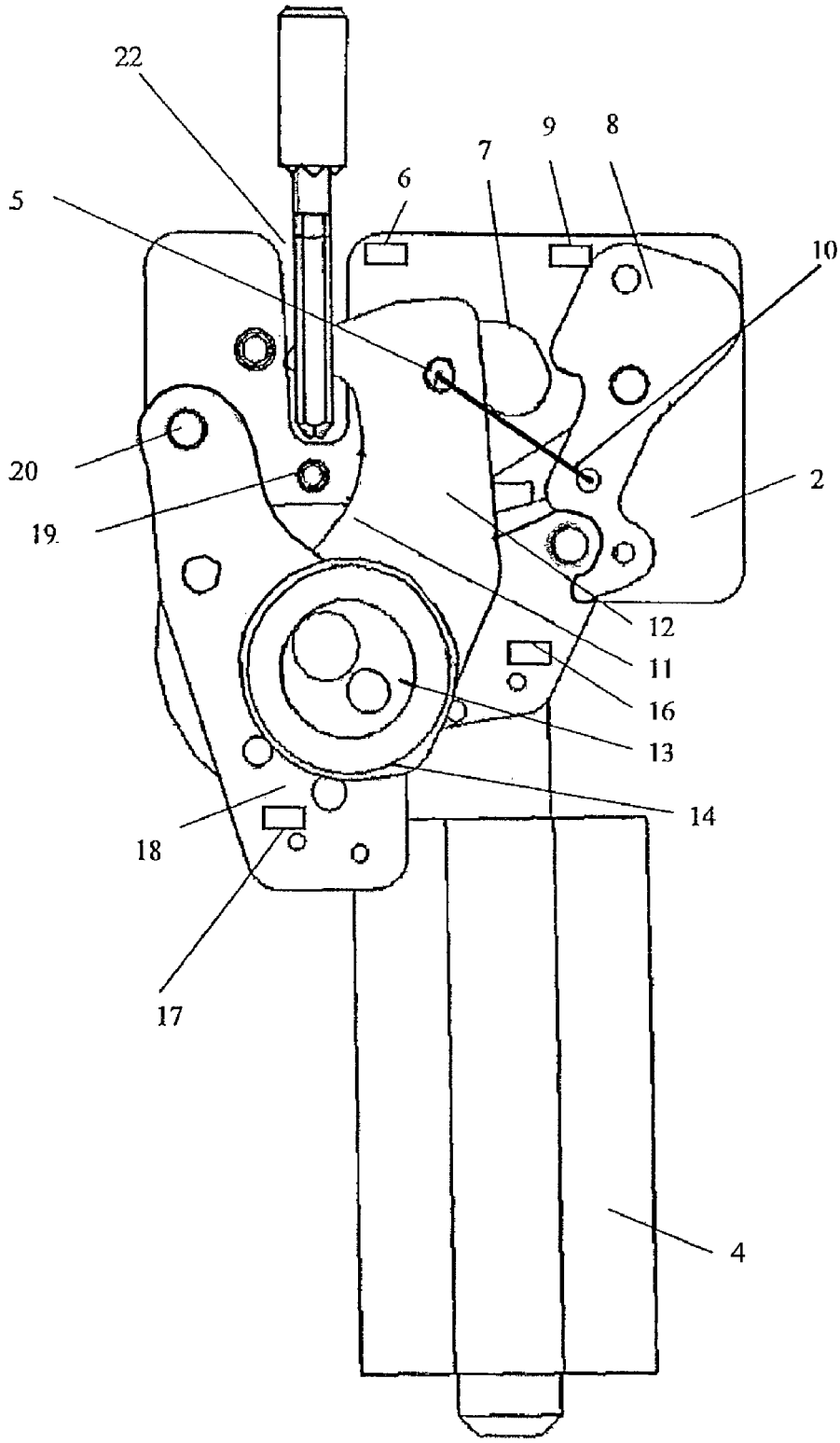
FIG. 2 shows a front view of the exemplary embodiment from FIG. 1 in a schematic view.

FIG. 2 shows the exemplary embodiment from FIG. 1 in a front view, also in a schematic illustration. The closure hook 12 is situated so it is pivotable on the rocker 18, which is in turn fastened to the retention and guide plate 2 so it is pivotable and/or tiltable around a pivot point 20. The closure hook 12 has a latch section on top, and is mounted at the bottom so it is rotatable around an eccentric or eccentric pin 13, for example, using a bushing (not shown in greater detail here). The circular eccentric 13 is situated on the driveshaft 3 (and is driven thereby), the centerpoint of the eccentric 13 not being coincident with the axis of the eccentric driveshaft 3, which is the basis of the eccentricity. A rotational movement of the eccentric may be converted into a back-and-forth and/or up-and-down movement of the closure hook 12 because the closure hook 12 is situated so it is rotatable on or around the eccentric 13, which results from the laws of mechanics. Further components of the cover closure are explained hereafter in connection with the function.

Figure 3:
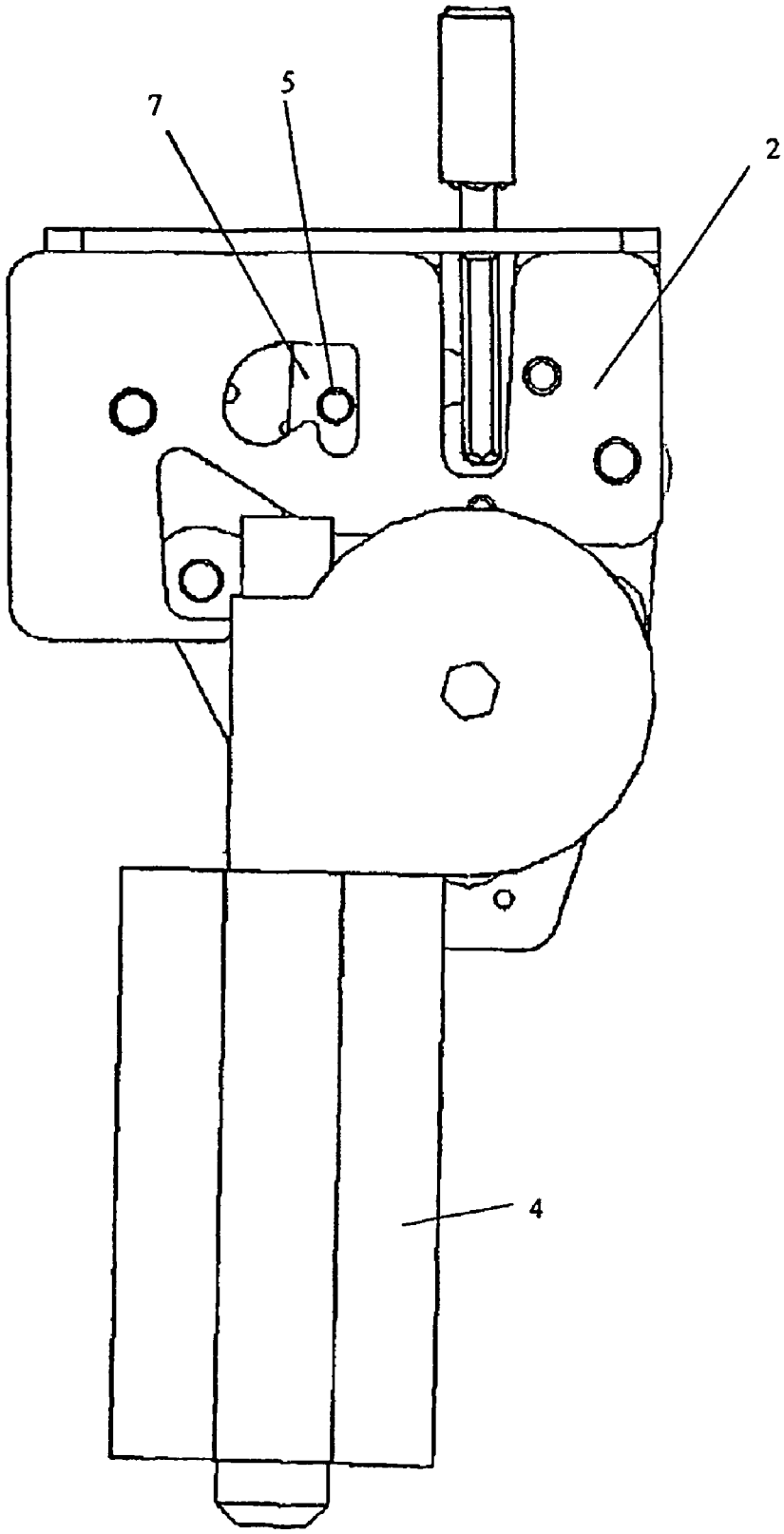
FIG. 3 shows a rear view of the exemplary embodiment from FIGS. 1 and 2 in a schematic view.

Upon closing (for example, upon transfer of the housing cover from an essentially vertical position into an essentially horizontal position around a corresponding pivot axis) of the housing cover, which is typically spring-loaded, the cover hook 1 situated on the housing cover plunges into the cover closure, for which the retention and guide plate 2 has a recess 22 at the relevant point, which may be seen very well from FIGS. 2 and 3. The cover hook 1 presses the closure hook 12 to the side against a spring force, to the right according to the illustration of FIG. 2. For this purpose, the closure hook 12 is equipped on its end facing toward the cover hook 1 with a curved slide guide and/or bevel. The closure hook 12 is simultaneously guided using a guide pin 5 in a crank 7 on the guide and retention plate 2 (cf. in particular FIG. 3), by which its movement scope is simultaneously also bounded, i.e., the crank 7 forms end stops for the closure hook movement in both directions. If the cover hook 1 finally plunges deep enough into the cover closure, the closure hook 12 snaps back because of its spring pre-tension, the latch section of the closure hook 12 engaging in an eye section of the cover hook 1 and/or engaging behind it. During this snapping back, a micro-switch 6 is actuated by the closure hook 12, which outputs a turning-on signal as a result, which puts the drive 4 (typically a DC drive having flanged-on gear) into gear, which drives the eccentric driveshaft 3 and the eccentric 13 situated thereon. As a result of the eccentric action, the closure hook 12 is moved downward in this case, i.e., in the closing direction, the cover hook 1 being carried along, and whereby the housing cover is solidly and securely closed. A cam lug 14 attached to the eccentric 13 actuates a micro-switch 17, which outputs a turning-off signal, which stops the drive 4 as soon as the closing position for the housing cover is reached, which is established via an associated rotational angle of the eccentric 13. The closing position is reached, for example, when the maximum eccentricity of the eccentric 13 points downward (in relation to the illustration in FIG. 2), the instantaneous points of rotation (axis of rotation of the eccentric driveshaft 3 and centerpoint of the eccentric 13) then being located one above another.

To open the housing cover, the cover closure according to one embodiment of the present invention may be opened by the operator via a switch (not shown). After this switch is actuated, the eccentric 13 rotates, driven by the drive 4 via the eccentric driveshaft 3, further in the same direction as upon closing, the closure hook 12 first moving upward. The closure hook 12 is simultaneously guided using the guide pin 19 on the guide plate 2 and pressed to the side again against the spring pre-tension (to the right according to the illustration in FIG. 2). The lateral movement occurs on the corresponding guide section (and/or guide path or contour) 11 on the closure hook 12, this guide section being implemented between the closure hook section in the upper area and the bearing section in the lower area. Finally, the closure hook 12, more precisely its latch section, and the cover hook 1 are disengaged and the housing cover to be opened is released. The eccentric 13 is now moved further until the closure hook 12 reaches a so-called snap position. The positioning is again performed controlled by the angle of rotation by the cam lug 14 on the eccentric, which triggers a micro-switch 16 when the relevant position is reached to thus stop the drive 4. The closure hook 12 now stops in this snap position. Both micro-switches 16 and 17 are situated on the rocker 18 in the exemplary embodiment shown.

Beyond the largely automated opening procedure, the cover closure may also be unlocked manually. For this purpose, the drive parts, including the drive 4, the eccentric driveshaft 3, and the eccentric 13, are situated together with the closure hook 12 on a rocker 18 which is fastened so it is pivotable and/or tiltable around a point of rotation 20 on the retention and guide plate 2. The rocker 18 may be unlocked against a spring 21 via a latch 8. The spring 21 now rotates the rocker 18, together with the drive 4, the eccentric 13, and the closure hook 12, counterclockwise (in relation to the illustration of FIG. 2) around the point of rotation 20, so that the right rocker section is pressed upward (in the direction of the housing cover). The guiding of the return movement for the closure hook 12 is again performed by the guide pin 5 within the crank 7, and also via a special coupling element 10, which connects the closure hook 12 to the latch 8 and via which predominantly traction forces may be transmitted in such a way that upon a return movement of the latch 8 into the unlocked position, the closure hook 12 is also simultaneously moved along. Finally, in this way the closure hook 12 and the cover hook 1 are also disengaged and the housing cover to be opened may be opened.

A reset of the cover closure from this state is performed by a rotation of the eccentric 13 (using the drive 4), and the support of the closure hook 12 in the crank 7 (using the guide pin 5), and the latch 8. A rocker journal of the rocker 18 engages again in a corresponding recess 22 on the latch 8.

Supplementary to the above embodiments, both the position of the cover hook 1 and also the position and/or setting of the latch 8 may be detected or registered via sensors or micro-switches. The micro-switch 6 is produced and positioned for the cover hook 1 in such a way that it is triggered or actuated by the plunging of the cover hook 1 into the cover closure. A micro-switch 9 is provided for the latch 8.

From the above statements, the drive 4 always drives the eccentric 13 in the same rotational direction in the exemplary embodiment described. However, it is also conceivable that the cover closure is actuated by different rotational directions of the eccentric 13.

The exemplary embodiment described above relates to a housing cover which is transferred upon closing from an essentially vertical position into an essentially horizontal position. Of course, it is also possible to situate the housing cover differently on the housing bottom part, so that all of the above direction specifications (top, bottom, lateral, right, etc.) only apply for the exemplary embodiment described, but are generally relative.

What is claimed is:

1. A cover closure for a housing of a laboratory device having a housing cover, comprising:

a closure hook which is configured to engage in a corresponding closure element on the housing cover, the closure hook being mounted so it is pivotable and movable translationally into a closed position after engaging in the closure element;

an eccentric;

a motor drive configured to drive the eccentric via an eccentric driveshaft;

a retention and guide plate;

a rocker; and a latch, wherein (i) the closure hook is mounted so it is pivotable on the eccentric and only movable translationally into the closed position by rotation of the eccentric, (ii) the closure hook, the drive, and the eccentric are operatively mounted on the rocker which is fastened around a point of rotation on the retention and guide plate so that the rocker is pivotable or tiltable around the point of rotation together with the closure hook, the drive and the eccentric, and (iii) the latch is configured to release and block the rocker.

2. The cover closure according to claim 1, wherein the closure hook is guided using a pin in a crank, the crank being situated on the retention and guide plate.

3. The cover closure according to claim 1, wherein the closure hook has a guide section, which optionally works together with a guide pin to move the closure hook into an open position.

4. The cover closure according to claim 1, wherein the closure hook is pre-tensioned into its engaging pivot position using a spring.

5. The cover closure according to claim 1, wherein the closure element comprises a cover hook.

6. The cover closure according to claim 1, further comprising a cam lug situated on the eccentric the cam lug being configured to actuate at least one micro-switch to allow a rotational angle control.

7. The cover closure according to claim 1, wherein the latch and the closure hook are connected via a coupling element.

8. A laboratory device housing having a housing cover and a housing bottom part, comprising a cover closure according to claim 1, which is supported by the housing bottom part.

9. The cover closure according to claim 5, wherein the closure hook is equipped with a slide guide or bevel, on which the corresponding cover hook may slide upon closing of the housing cover and snap into a pre-engaged position.

* * * * *

UNITED STATES PATENT AND TRADEMARK OFFICE

CERTIFICATE OF CORRECTION

PATENT NO. : 8,403,380 B2
APPLICATION NO. : 12/388958
DATED : March 26, 2013
INVENTOR(S) : Thomas Ballhause It is certified that error appears in the above-identified patent and that said Letters Patent is hereby corrected as shown below:

In the Claims

Column 6, line 26, change "further comprising a cam lug situated on the eccentric the cam lug being configured" to --further comprising a cam lug situated on the eccentric, the cam lug being configured--.

Signed and Sealed this
Eighteenth Day of June, 2013

Teresa Stanek Rea
*Acting Director of the United States Patent and Trademark Office*